United States Patent [19]

Check, Jr.

[11] 4,050,374

[45] Sept. 27, 1977

[54] METER SETTING MECHANISM

[75] Inventor: Frank T. Check, Jr., Hamden, Conn.

[73] Assignee: Pitney-Bowes, Inc., Stamford, Conn.

[21] Appl. No.: 698,261

[22] Filed: June 21, 1976

[51] Int. Cl.[2] ..... B41J 1/22

[52] U.S. Cl. ..... 101/91; 101/45; 101/110

[58] Field of Search ..... 101/91, 92, 110, 45, 101/95–99; 235/60 P, 101

[56] References Cited

U.S. PATENT DOCUMENTS

| | | | |
|---|---|---|---|
| 3,606,833 | 9/1971 | Deutsch | 101/45 |
| 3,682,378 | 8/1972 | Rovan et al. | 235/101 |
| 3,776,130 | 12/1973 | Tamiya | 101/45 |
| 3,823,666 | 7/1974 | Hanson | 235/58 P X |
| 3,965,815 | 6/1976 | Lupkas et al. | 101/91 |
| 3,977,320 | 8/1976 | Lupkas et al. | 101/110 |

*Primary Examiner*—Edward M. Coven

*Attorney, Agent, or Firm*—Robert S. Salzman; William D. Soltow, Jr.; Albert W. Scribner

[57] ABSTRACT

For sequentially setting independently-rotatable spur gears which are coupled to print wheels in a postage meter, a yoke carrying a selectively-driven master gear is shifted along an axis parallel to the common axis of the adjacent gears. A rack attached to the yoke is driven by a pinion gear on a stepping motor shaft. The yoke is spring-biased to a disabled position in which the spur gears are mechanically locked into position by tooth troughs on the yoke surface. A print interlock mechanism permits printing only when the yoke is held in an enabled position against the force of the biasing spring.

10 Claims, 10 Drawing Figures

Fig. 3.
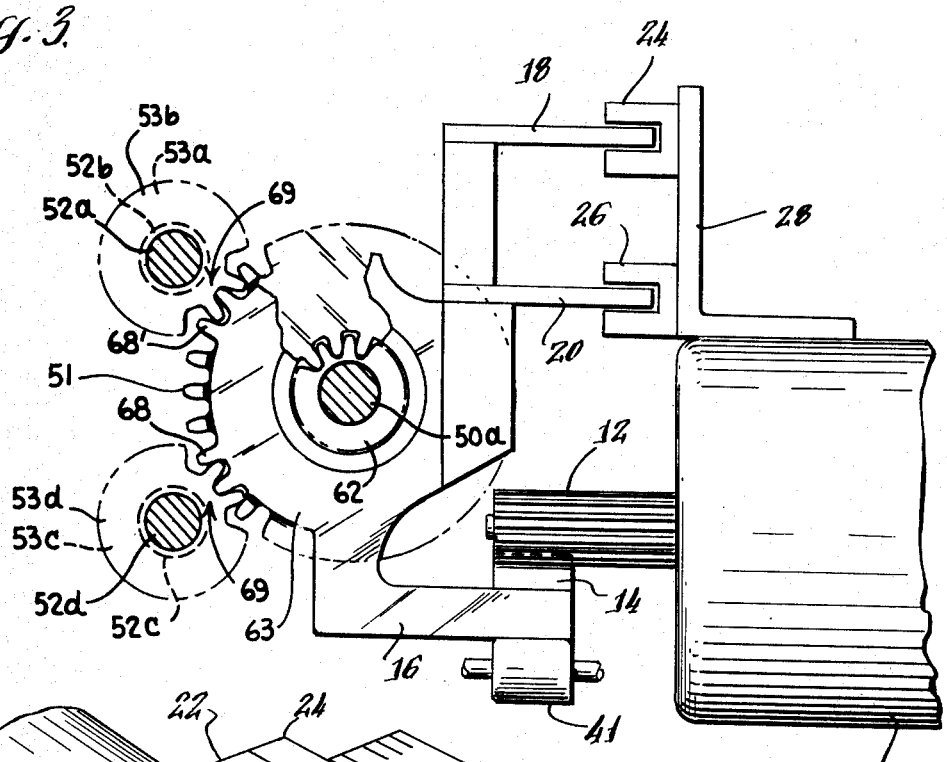
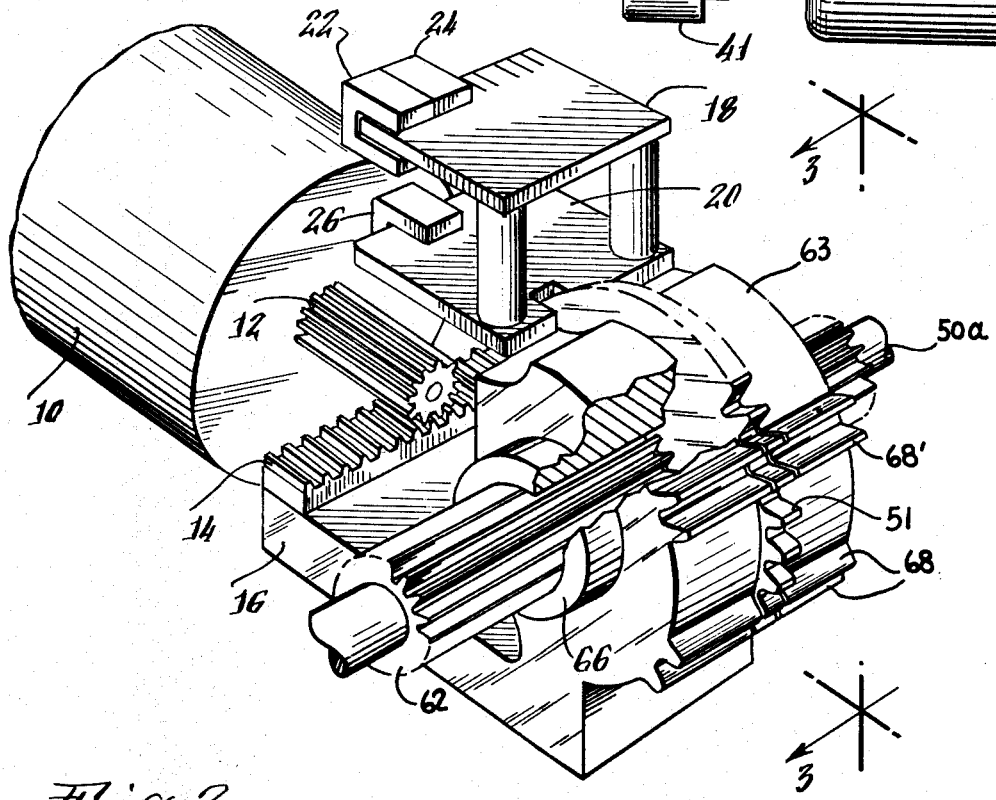
Fig. 2.

METER SETTING MECHANISM

BACKGROUND OF THE INVENTION

The present invention relates to a postage meter and more particularly to a meter setting mechanism for setting print wheels in a postage meter.

Postage meters in use today typically include a set of four adjacent print wheels, each of which carries print characters zero through nine. The print wheels can be independently positioned to allow a user to set any amount of postage between $00.00 (for test purposes) and $99.99.

The print wheels in the type of postage meter in widespread commerical use today are manually set by a user through a series of mechanical linkage and levers. Setting the print wheels manually is no problem for users who process relatively little mail on a daily basis. However, some users process an extremely high volume of mail on a daily basis and need a postage meter with extremely high throughout.

While meter mechanisms in use today can be adapted to more automated operation by using electric motors to drive the linkage and mechanical meter assemblies, such assemblies were not originally designed for operation at high speeds over extended periods of time. The long term mechanical integrity of the linkages and the maximum meter setting speeds attainable are not as high as might be desired. Also, the amount of space required for the linkages and levers has made it difficult to incorporate the slightly-modified mechanical meters into larger systems.

A meter setting mechanism more suited for use in automated systems has been developed. In this system, the print wheels are set by independently-rotatable, adjacent spur gears which are successively meshed with a master gear. The master gear is rotatably-mounted within a yoke which can be shifted along an axis parallel to the common axis of the spur gears. Rotation of the master gear is controlled by a stepping motor. Lateral movement of the yoke is controlled by a pair of solenoids which can be energized individually or simultaneously to rotate pivot arms coupled to the yoke through a toggle pin which serves as a rotary-to-reciprocating motion converter. The pivot arms are spring biased to oppose the actions of the energized solenoids.

While the system just described elminates many of the cumbersome linkages found in prior meter setting mechanisms it is felt that there is still room for improvement. A number of mechanical linkages remain in the described mechanism. Thus, long term reliability problems inherent in mechanical linkages, while greatly reduced are, not completely eliminated. Also, since one or both solenoids are energized at the same time the master gear motor is energized, the power requirements of the meter setting mechanism are higher than desired. Moreover the normal action and reaction of the springs used to bias the solenoids causes vibrations within the system which delay the settling time when the master gear yoke is shifted to new lateral positions.

Finally, the maximum number of yoke positions is limited to four, representing all the possible energization combinations for two dual-position solenoids. Increasing the number of yoke positions to permit more digits to be printed or for security purposes would require development of a new and considerably more complex solenoid mechanism. The use of additional solenoids would, of course, aggravate such problems as settling time and power requirements.

The present system was conceived as an improved meter setting mechanism, that would provide better security and a more positive lock up.

SUMMARY OF THE INVENTION

The present invention is a meter setting mechanism which is spring-biased toward a disabled position in which all print wheels are mechanically locked into place, and where the meter printer is prevented from operating. This mechanism also provides more positive lateral positioning of a master gear without mechanical linkages and with reduced power requirements.

This meter setting mechanism is intended for use in a printing device having banks of print wheels which may be set to different positions through a gearing assembly which includes a number of laterally-spaced, independently-rotatable gears. Each of the gears may be separately meshed with a motor-driven master gear rotatably mounted with a laterally-movable yoke. The yoke can be laterally shifted through a number of positions equal to the number of print wheel banks plus at least one additional position wherein a tooth trough mechanically locks the independently-rotatably gears to prevent resetting from outside the meter. The yoke is biased toward this position.

The motor which shifts the master gear laterally is coupled directly to the yoke through simple rack and pinion gears, allowing lateral positioning to be carried out quickly and accurately. Moreover, the power requirements for the system are reduced since the motor controlling the lateral movement of the master gear is not energized at the same time as the motor controlling the rotary position of the master gear.

DESCRIPTION OF THE DRAWINGS

While the specification concludes with claims particularly pointing out and distinctly claiming that which is regarded as the present invention, further details of a preferred embodiment of the invention may be more readily ascertained from the following detailed description when read in conjunction with the accompanying drawings wherein:

FIG. 2 is an enlarged, partially cut away perspective view of the yoke, master drive gear, splined shaft and position indicator of the meter setting mechanism shown in FIG. 1;

FIG. 3 is a view taken along line 3—3 in FIG. 2;

DETAILED DESCRIPTION

Figure 1:
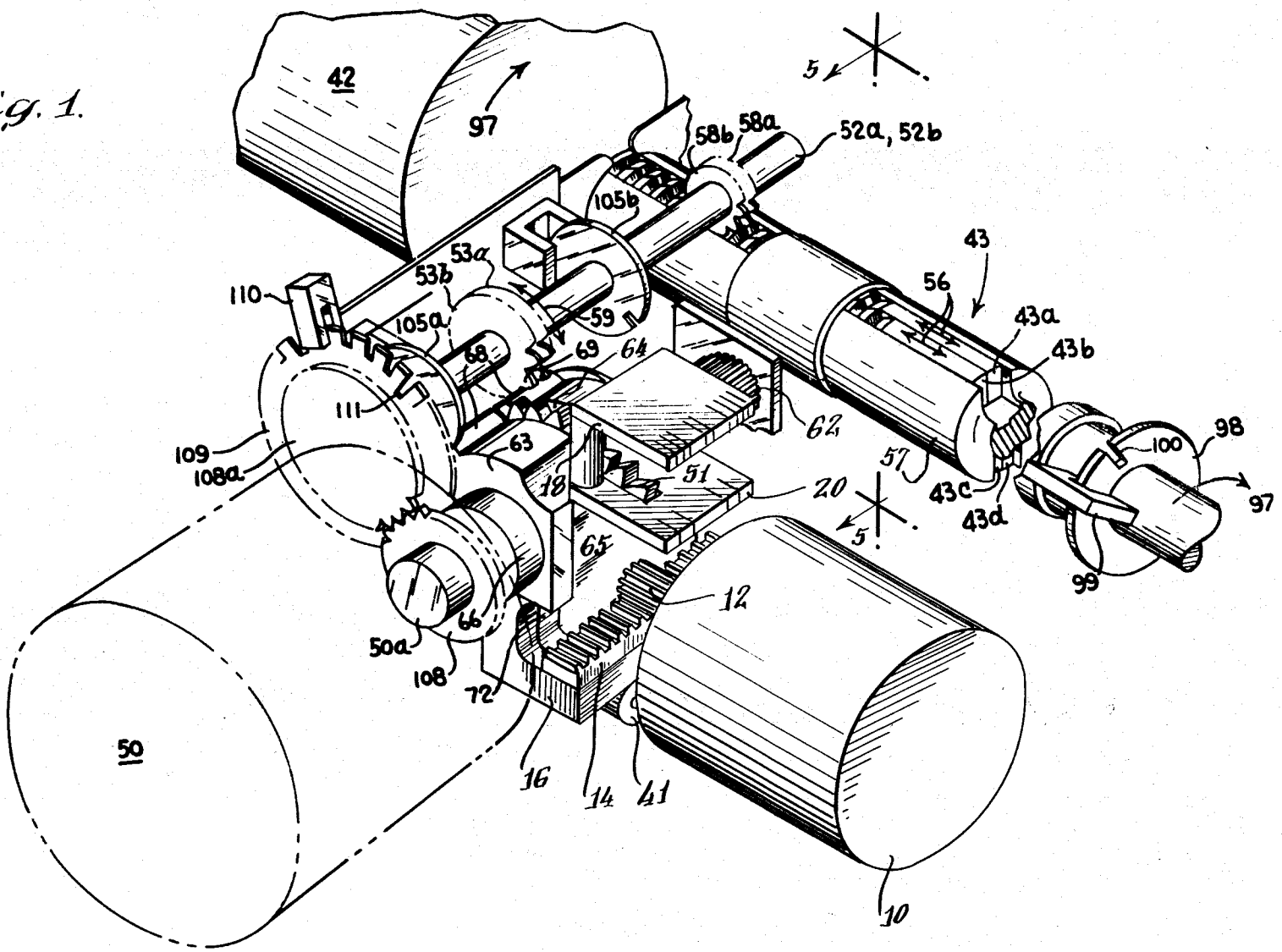
FIG. 1 is a perspective view of a postage setting and printing apparatus including the improved meter setting mechanism.

Referring to FIG. 1, a meter setting mechanism constructed in accordance with the present invention is used, in a preferred embodiment, to set print wheels contained within a print drum 42 of a modified Model 5300 postage meter manufactured by Pitney Bowes, Inc., Stamford, Connecticut. The basic Model 5300 postage meter is a mechanical device with mechanical registers and actuator assemblies. The modified meter contains only the print drum 42 and print wheel driving racks 43. Since the modified meter is intended to be used in an electronic system, the mechanical registers and actuator assemblies have been removed.

The print wheels (not shown) within drum 42 are set by a mechanism driven by first stepping motor 50 and a second stepping motor 10. Signals for controlling the operation of the stepping motors 50 and 10 would normally be provided by an electronic control of the type disclosed in co-pending application Ser. No. 536,248 filed on Dec. 23, 1974, and assigned to the assignee of the present invention. Since the electronic control unit is not part of the present invention, no details as to its construction or operation are provided herein.

Mechanical features of the meter setting mechanism are described with reference to FIGS. 1, 2 and 3. The stepping motor 50 drives an upper and lower set 43 of postage wheel driving racks (consisting of racks 43*a*, 43*b*, 43*c*, 43*d*) through a gearing assembly including upper and lower nested shafts 52*a*, 52*b*, 52*c*, and 52*d*, respectively. The angular positions of the upper shafts 52*a*, 52*b*, and the lower shafts 52*c*, 52*d* are controlled by a master gear 51 which may be driven in either a clockwise or a counterclockwise direction by the stepping motor 50.

The print drum 42 has four independently-positioned print wheels (not shown) which provide a postage impression to the maximum sum of $99.99. Each print wheel provides a separate digit of this sum and can be set from "0" to "9". The print wheels are sequentially set by the meter setting mechanism by means of the four driving racks 43*a*, 43*b*, 43*c*, 43*d*. The driving racks are slidable within print drum shaft 57 in the direction indicated by the double-headed arrows 56.

The settings of the upper racks, 43*a* and 43*b* are controlled by pinion gears 58*a* and 58*b*, respectively. The settings of the lower racks 43*c* and 43*d* are controlled by a similar set of pinion gears not shown in the drawings. The pinion gear 58*a* is attached to the inner shaft 52*a* while the pinion gear 58*b* is attached to the concentric outer shaft 52*b*. The pinion gears which control the settings of driving racks 43*c*, 43*d* are similarly attached to nested shafts 52*c* and 52*d*, shown only in FIG. 3. The angular positions of the nested shafts 52*a*, 52*b*, 52*c*, 52*d* are controlled by shaft-mounted spur gears 53*a*, 53*b*, 53*c*, 53*d*. The master gear 51 can be shifted laterally along an axis parallel to the axis of the spur gears 53*a*, 53*b*, 53*c*, 53*d* to intermesh with a single gear at a time. The master gear 51 is rotatably mounted within a slot 64 in a yoke 63 which slides along a splined shaft 62. The yoke 63 is held away from rotatable engagement with splined shaft 62 by an interposed sleeve bushing 66. The master gear 51 engages the gears 53*a*, 53*b*, 53*c*, 53*d* in the sequential order: 53*b*, 53*a*, 53*d*, 53*c*. In this order, gear 53*b* controls the setting of the "tens of dollars" print wheel, gear 53*a* controls the "dollars" print wheel, gear 53*d* controls the "tens of cents" print wheel and gear 53*c* controls the "units cents" print wheel.

The yoke 63 includes a pair of upper and lower tooth trough walls 68 and 68' located on the upper and lower surfaces of the yoke 63. As the yoke 63 and master gear 51 slide laterally along the splined shaft 62, the upper and lower laterally-extending walls 68 and 68' slide along either side of one of the teeth in each of the spur gears. The tooth troughs prevent rotational movement of any of the spur gears other than a spur gear meshed with master gear 51.

The lateral position of yoke 63 and the master gear 51 is controlled by stepping motor 10, the output shaft of which carries a splined gear 12. The splined gear 12 meshes with a rack 14 attached to yoke 63 at an L-shaped, lower extension 16. The clockwise or counterclockwise rotation of splined gear 12 upon energization of stepping motor 10 is translated into lateral movement of yoke 63 through the rack and pinion arrangement. The splined gear 12 prevents counterclockwise rotation of yoke 63 due to any friction between rotating sleeve bushing 66 and the yoke 63. A roller 41 mounted beneath L-shaped extension 16 prevents any clockwise movement of yoke 63.

When the print wheels within print drum 42 are set to the correct postage value position, drum 42 is rotated by means of shaft 57 in a direction indicated by arrow 97 to imprint that postage. The drum 42 is then returned to a home position sensed by a slotted disk 98 affixed to shaft 57. When a slot 100 of disk 98 moves between the arms of an optical detector 99, the shafts 57 is at its home position.

All optical detectors of the setting mechanism are basically U-shaped structures having a light emitting diode located in one arm and a phototransistor located in the other arm of the U-shaped structure. Light emitted by the light emitting diode is transmitted to the phototransistor only when the slot is aligned with the arms of the read-out well.

The home positions of shafts 52*a* and 52*b* which are the "O" settings for the "dollars" and "tens of dollars" print wheels are similarly monitored by slotted disks 105*a* and 105*b*, respectively, in combination with optical detectors adjacent those slotted disks. The home positions of shafts 52*c* and 52*d* which are the "0" settings for the "cents" and "tens of cents" print wheels are monitored by similar slotted disks and optical detectors. It is necessary to reset each of the print wheels to the "0"setting on start-up. Thereafter, the settings of the print wheels are monitored to permit resetting from previously established wheel positions.

The angular movement of the stepping motor shaft 50*a*, (and consequently splined shaft 62 and master gear 51) is monitored through an assembly including gears 108 and 108*a*, slotted monitoring wheel 109 and optical detector 110. When the stepping motor shaft 50*a*, turns, gear 108, which is mounted on shaft 50*a*, must also turn through the same angle. Gear 108 intermeshes with gear 108*a* carried by the slotted monitoring wheel 109 causing wheel 109 to rotate in correspondence with rotation of shaft 50*a*. Every fifth slot 111 on monitoring wheel 109 is extra long to provide a check on the monitoring wheel operation. Each slot on wheel 109 corresponds to a change of one unit of postage value. Optical detector 110 has two photosensors. One of the photosensors is mounted near the bight of the U-shaped detector structure; that is, near the periphery of monitoring wheel 109. This photosensor monitors every step of the stepping wheel 109. The other sensor is located near the ends of the arms of detector 110. This photosensor receives light from an associated light source on the opposite side of the monitoring wheel 109 only when the extra long slot 111 is aligned with the detector arms. Thus, this sensor monitors every fifth step of the monitoring wheel 109. The number of slots on wheel 109 which pass through detector 109 during rotation of motor 50 are counted in a control unit for the meter. If the counter does not contain a count of five when the output from the second photosensor in detector 110 is sensed (indicating long slot 111 is aligned in the detector), an error condition exists.

The lateral position of yoke 63 and master gear 51 is monitored by a position indicator including a pair of spaced plates 18, 20 attached directly to yoke 63. Plates 18 and 20 include slot patterns which are binary-encoded representations of the position of the yoke relative to optical detectors 22, 24, 26 all of which are attached to an L-shaped bracket 28 on stepping motor 10. Each different slot pattern identifies a particular position of yoke 63.

Figure 4:
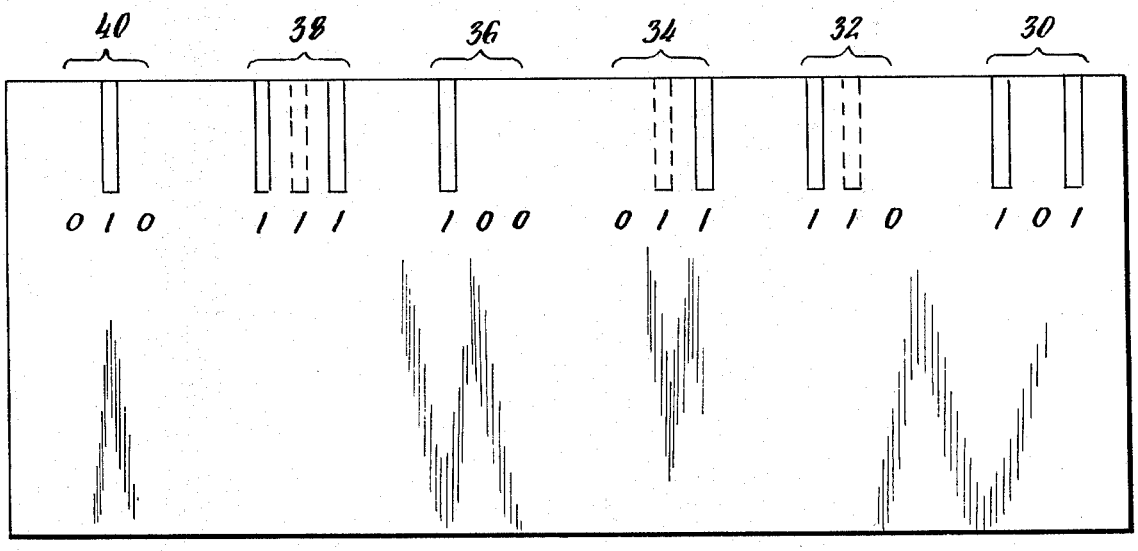
FIG. 4 is a plan view of one embodiment of a position encoder.

The slot patterns may be more clearly with reference to FIG. 4, which is a plan view of plate 18. Slots appearing in plate 20, which is vertically aligned with plate 18 and therefore substantially hidden, are shown in dotted outline form.

In a preferred embodiment of the invention, plates 18 and 20 have six different binary slot patterns identifying six lateral positions for yoke 63. Each of the slot patterns consists of a unique triplet in which the presence of a slot in either plate 18 or plate 20 is interpreted as a binary one while the absence of a slot in any position where a slot might appear is interpreted as a binary zero. The binary indicia for the two outside positions in each triplet are included on plate 18. The binary indicia for the center position in each triplet is included on plate 20. The binary indicia are distributed between two vertically aligned plates only because optical detectors 22, 24, 26 are too bulky to permit three detectors to be placed side by side on a single plate of reasonable size. From a logic standpoint there is no significance to the fact the indicia are distributed between two plates. The indicia are read and interpreted as if they were contained on a single plate.

Position 30, identified by the binary slot pattern "101" is the detected slot pattern when master gear 51 is meshed with the spur gear for the "tens of dollars" bank of the postage meter. Position 32, identified by binary slot pattern "110", is detected when master gear 51 meshes with the spur gear for the "dollars" printing wheel. Position 34, identified by binary pattern "001", is detected when master gear 51 meshes with the spur gear which sets the "tens of cents" print wheel on the postage meter. The "cents" print wheel is set by master gear 51 in position 36, identified by the binary pattern "100".

Positions 38 and 40, identified by binary patterns "111" and "010", respectively, serve security purposes. After each of the print wheels has been set by the master gear 51, yoke 63 is shifted to an "enabled" position 40 which is the only position in which shaft 57 can rotate to imprint the set postage. A mechanical interlock between the yoke 63 and a shutter bar described in more detail below is released only in this position to assure the printing cannot occur if the meter is not ready due to any reason or if an error has occurred or if insufficient funds are available in the meter register.

Position 38, referred to as a disabled position, is a position wherein each of the spur gears 53*a*, 53*b*, 53*c*, 53*d* is mechanically locked by the projecting trough walls 68, 68' on the surface of yoke 63. Since yoke 63 is held from counterclockwise rotation by spline gear 12 and from clockwise rotation by roller 41, the trough walls mechanically lock the print wheels to prevent anyone from forcing the accessible print wheels into a new position. Any attempt to tamper with the meter in this manner would be readily detected since the print wheel positions could not be altered without mechanically damaging the yoke or gears. The yoke 63 is spring-biased from the enabled position to the disabled position upon loss of power to stepping motors of 10 and 50. The biasing spring is part of a print interlock mechanism, one possible embodiment of which is described in more detail below.

Figure 5:
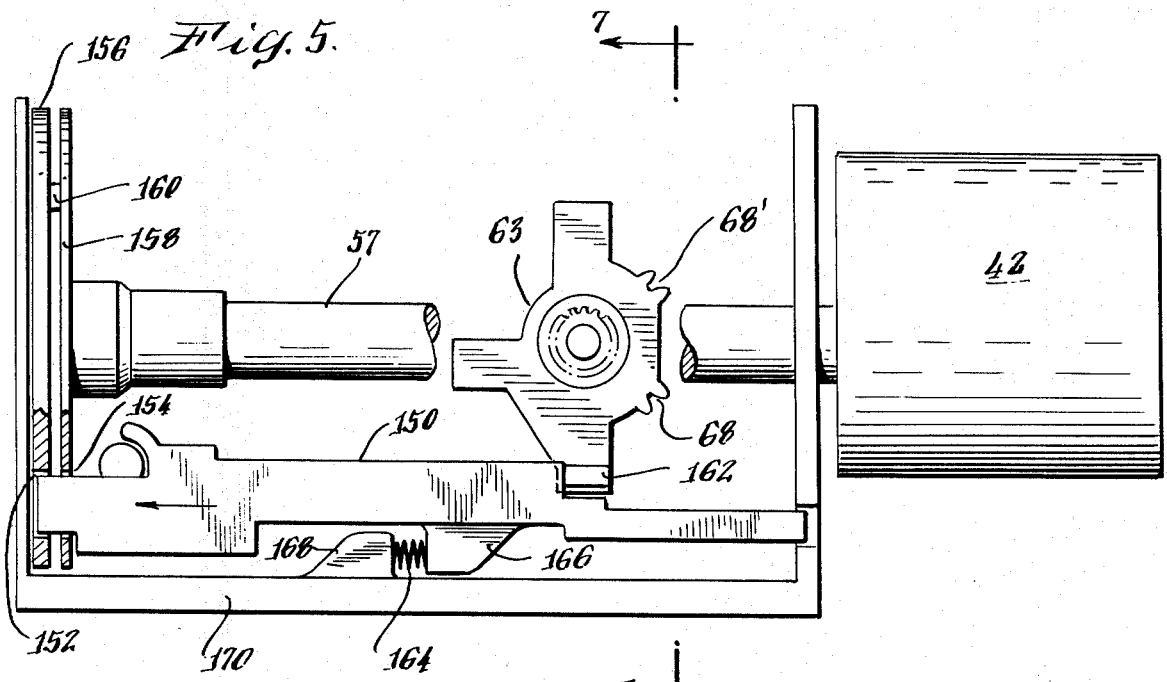
FIG. 5 is an elevation of a print interlock mechanism in a blocking position, generally taken along lines 5—5 of FIG. 1.

Details of print interlock mechanism are described with reference to FIGS. 5–9. While the description describes a shutter bar interlock system not unlike that in actual use within the meter, the actual details and the exact construction and operation of this system are not shown for purposes of security. FIG. 5 is a view along lines 5-5 of FIG. 1 with a number of elements omitted for the sake of simplicity. The print interlock mechanism includes a shutter bar 150 which, in the illustrated extreme left or blocking position, extends into slots 152 and 154 in drive plates 156 and 158, respectively. Drive plate 156 is ridigly coupled to and rotates with the shaft of a print motor (not shown). Drive plates 156 and 158 are coupled through a pin 160 which rotates plate 158, and consequently shaft 57 and print drum 142, when the print motor is energized. The shutter bar 150 is held in the blocking position by a camming extension 162 which extends laterally from yoke 63. The camming extension 162 holds the shutter bar 150 in the blocked position against biasing forces provided by a coil spring 164 trapped between a rib 166 on shutter bar 150 and another rib 168 extending upwardly from a stationary frame 170.

Figure 6:
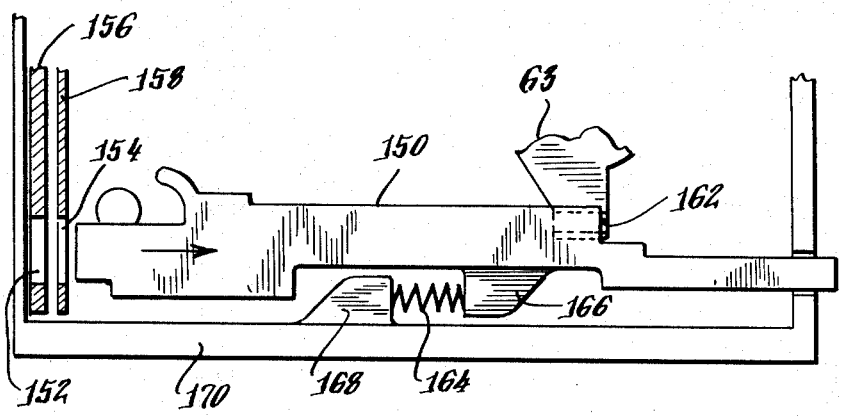
FIG. 6 is an elevation of the same print interlock mechanism in a release position.
Figure 7:
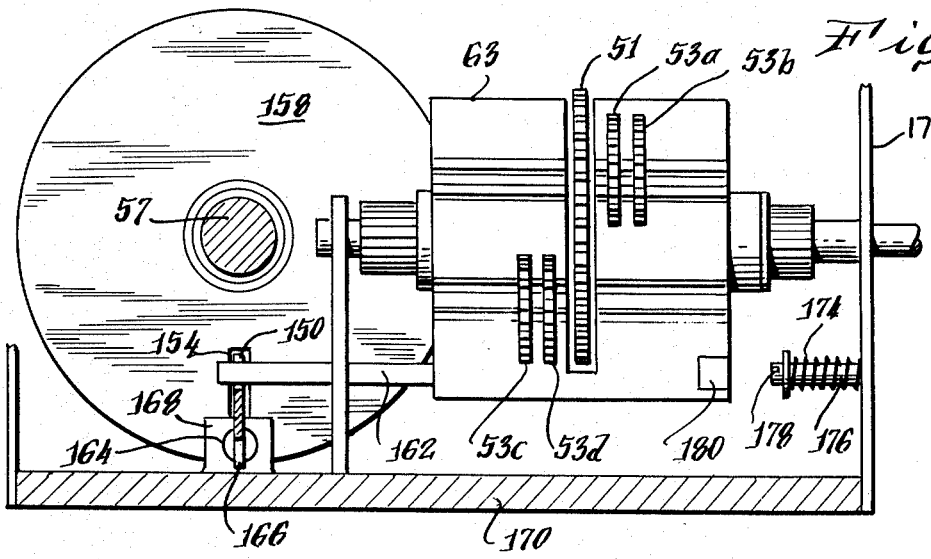
FIG. 7 is a view of the print interlock mechanism taken along lines 7—7 in FIG. 5.

Referring to FIG. 7, the meter is enabled when yoke 63 is driven toward a frame member 172 and held there by motor 10. In this position, a coil spring 174 mounted on a pin 176 affixed to frame 172 will be compressed by the yoke with the head 178 of the pin entering a recess 180 in a lower portion of the yoke 63. Movement of yoke 63 to an extreme right hand position withdraws camming extension 162 from contact with shutter bar 150, allowing coil spring 164 to force shutter bar 150 away from drive plates 156 and 158. This is illustrated in FIG. 6. When the left end of shutter bar 150 is clear of drive plates 156 and 158, the print interlock is released, permitting plates 156 and 158, shaft 57 and print drum 42 to rotate to imprint the postage.

Figure 8:
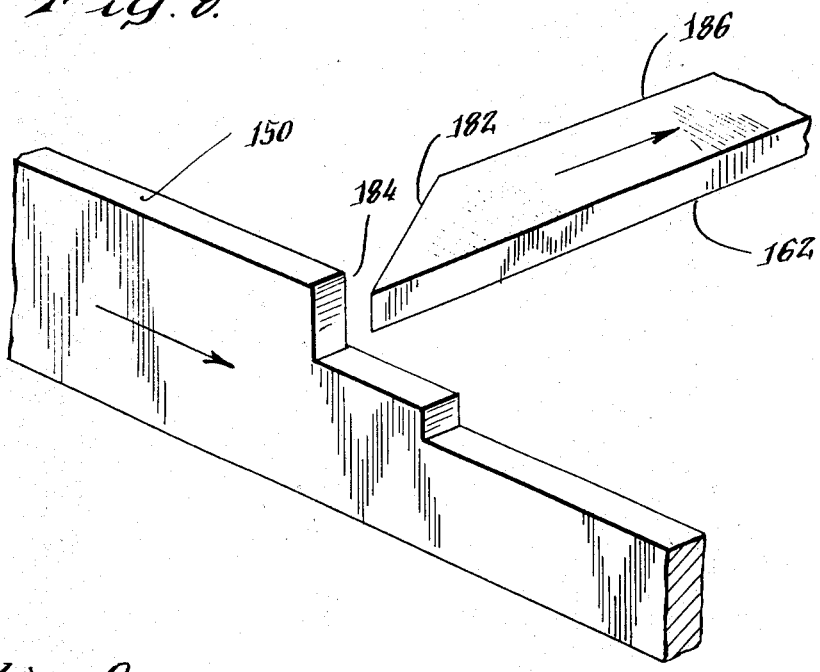
FIGS. 8 and 9 are detailed partial perspective views of a shutter bar and camming extension in the print interlock mechanism in the blocking and release positions, respectively.
Figure 9:
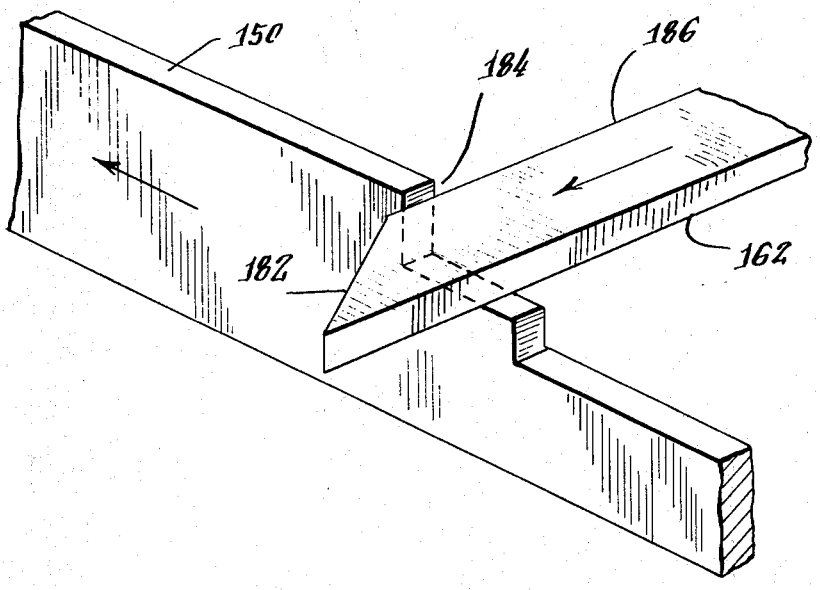

The shutter bar 150 is returned to a blocking position by camming extension 162 when yoke 63 is shifted to any position other than the enabled position. The camming action is illustrated in FIGS. 8 and 9. In FIG. 8, camming extension 162 is withdrawn from contact with shutter bar 150 as it would be when yoke 63 has been shifted to the extreme right and/or enabled position. With camming extension 162 withdrawn, coil spring 164 can force shutter bar 150 to the right or to a released position.

As yoke 63 leaves the enabled position, camming extension 162 is shifted into contact with shutter bar 150. An angled surface 182 on extension 162 bears against a shoulder 184 of shutter bar 150 to force the shutter bar to the left against the force of spring 164. The shoulder 184 of shutter bar 150 is seated against an edge 186 of camming extension 162 when the yoke 63 is in any position other than the enabled position.

The simple mechanical interlock provided by shutter bar 150 and camming extension 162 positively prevent printing unless the yoke 63 is in the enabled position. Due to the simplicity and reliability of the print interlock, no other mechanical or electrical interlocks are needed.

Referring again to FIG. 7, the independently-rotatable spur gears 53*a*, 53*b*, 53*c* and 53*d* are shown in simplified form. The spacing of the spur gears and the size of yoke 63 is such that a tooth of each of the spur gears rides in one of the tooth troughs on the yoke surface when yoke 63 is in either its enabled or disabled positions. When yoke 63 is in one of the other positions (generally referred to a bank select position), one of the spur gears will be aligned with the master gear 51.

As indicated earlier, the tooth troughs mechanically lock the print wheels into position, preventing the repositioning of the print wheels from the exterior of the meter. Thus, in either the enabled position of the yoke or the disabled position (to which the yoke is returned either by normal operation of motor 10 or by coil spring 174 upon loss of power when the meter is enabled), the print wheel settings cannot be altered. Also, since all spur gears are held in alignment in both the enabled and disabled positions, there is little risk the mechanism will be jammed in the enabled position.

Figure 10:
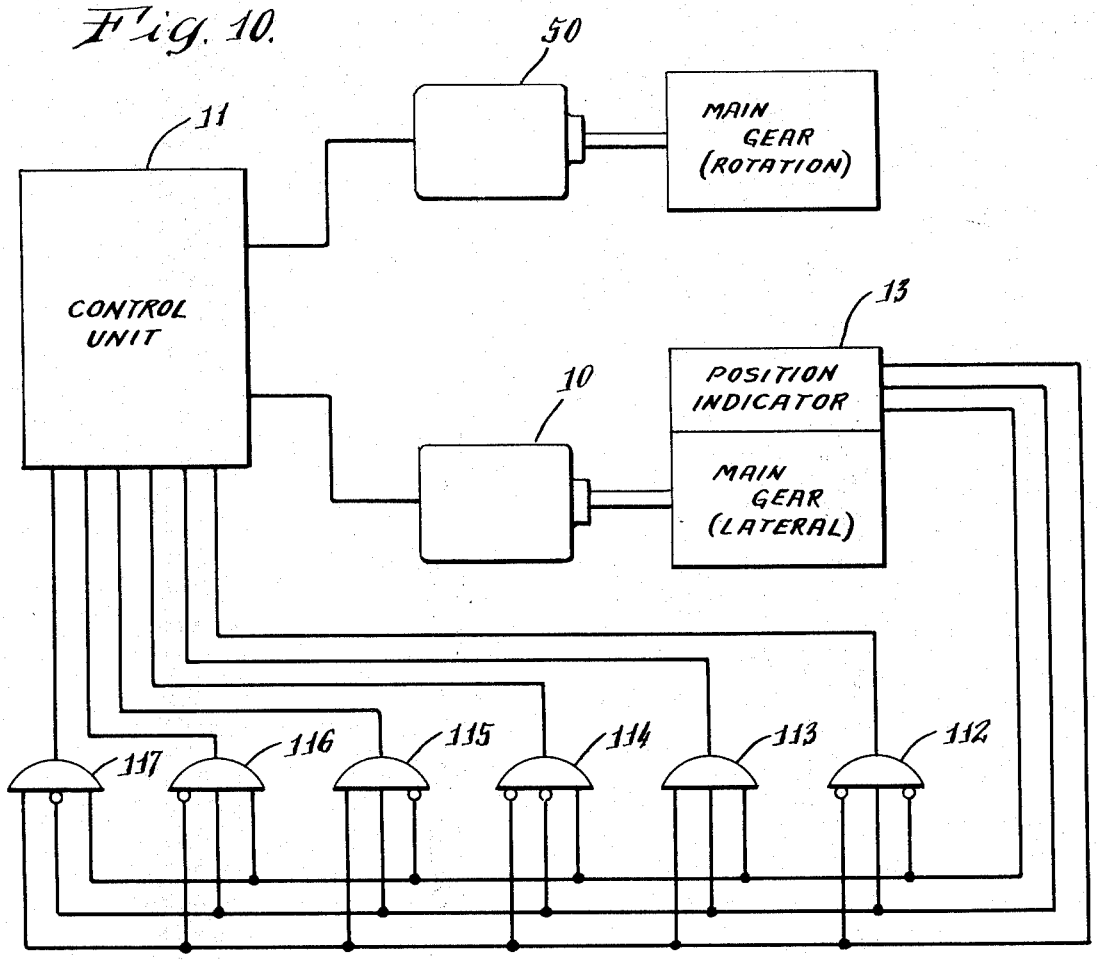
FIG. 10 is a simplified schematic representation of one type of position recognition logic which may be employed with the meter setting mechanism.

Referring to FIG. 10, a control unit 11 for setting the meter is shown only in block diagram form since the control unit 11 is not part of the present invention. Any control unit which can provide a series of stepping motor pulses for stepping motor 50 and stepping motor 10 would suffice. Stepping motor 50, of course, controls the rotary motion of the master gear. Lateral movement of the master gear is controlled by stepping motor 10. The lateral position of the master gear is detected by the position indicator consisting of plates 18, 20 and optical detectors 22, 24, 26 all of which are indicated only by position indicator block 13.

The outputs of the optical detectors in the position indicator consist of three binary signals which, is one embodiment of the invention, could be applied to a series of AND gates 112, 113, 114, 115, 116, 117. The output of each AND gate is normally low, going high only when a particular binary triplet of signals is applied at the input. For example, the output of AND gate 112 goes high if, and only if, binary pattern "010" is detected by the optical detectors. The AND gates effectively serve as a decoder for the detectors permitting one of six possible position signals to be applied to control unit 11 based on the readings of the three detectors.

While six laterally-spaced yoke positions exist in the illustrated embodiment, it would be a very simple matter to add any number of laterally-spaced positions. Additional binary-encoded slot patterns would have to be provided on plates 18 and 20. Depending on the number of additional positions desired, additional optical detectors might be needed.

The triplet patterns are not arranged in the normal binary sequence. To reduce the chances of an undetected error, the triplet patterns have been selected so that at least two out of the three binary digits change as the yoke moves from one position to an adjacent position.

While there has been described what is considered to be preferred embodiments of the invention, variations and modifications will occur to those skilled in the art once they become familiar with the basic concepts of the invention. Therefore, it is intended that the appended claims shall be construed to include all such variations and modifications as fall within the true spirit and scope of the invention.

What is claimed is:

1. For use in a printing device having a rotatable printing drum and means for rotating said drum and further having banks of print wheels which may be set to different positions through a gearing assembly including a number of laterally-spaced, independently-rotatable gears, an improved gear-setting mechanism including:

a. a laterally-moveable yoke including restraining means for normally preventing rotational movement of the independently-rotatable gears;

b. a master gear rotatably mounted within said yoke for engaging a single one of the independently-rotatable gears at a time, during which time the engaged independently-rotatable gear can be rotated by the master gear;

c. a print interlock means for normally preventing printing by the printing device, said print interlock means further comprising:

1. a shutter bar which can extend into and block the path of movement of said means for rotating said printing drum;

2. an extension of said laterally-moveable yoke for holding the shutter bar in a blocking position when said yoke is in any position other than an enabled position;

3. means for driving said shutter bar from the blocking position to a released position only when said laterally-moveable yoke is in said enabled position; and d. means for urging said yoke laterally into said enabled position wherein said print interlock means is released but each of the independently-rotatable gears continues to be restrained from rotational movement.

2. An improved gear-setting mechanism as recited in claim 1 wherein said rotation-restraining means on said yoke comprises at least one set of spaced walls defining a trough for receiving a tooth of each of the independently-rotatable gears.

3. For use in a printing device having a rotatable printing drum and means for rotating said drum and further having banks of print wheels which may be set to different positions through a gearing assembly including a number of laterally-spaced, independently-rotatable gears, an improved gear-setting mechanism including:

a. a laterally-moveable yoke including restraining means for normally preventing rotational movement of the independently-rotatable gears;

b. a master gear rotatably mounted within said yoke for engaging a single one of the independently-rotatable gears at a time, during which time the engaged independently-rotatable gear can be rotated by the master gear;

c. a print interlock means for normally preventing printing by the printing device, said print interlock means further comprising:

1. a shutter bar which can extend into a block the path of movement of said means for rotating said printing drum, 2. an extension on said laterally-moveable yoke for holding the shutter bar in a blocking position when said yoke is in any position other than an enabled position;

3. means for driving said shutter bar from the blocking position to a released position only when said laterally-moveable yoke has been driven into said enabled position;

d. means for biasing said yoke toward a disabled position wherein said print interlock means prevents printing and wherein each of said independently-rotatable gears is restrained from rotational movement by the restraining means on said laterally-moveable yoke; and e. means for urging said yoke laterally into said enabled position wherein said print interlock means is released but each of the independently-rotatable gears continues to be restrained from rotational movement.

4. An improved gear-setting mechanism as recited in claim 3 wherein said rotation-restraining means on said yoke comprises at least one set of spaced walls defining a trough for receiving a tooth of each independently-rotatable gears.

5. An improved gear-setting mechanism as recited in claim 4 wherein said yoke-biasing means comprises a laterally-extending spring for resisting lateral movement of the yoke into the enabled position.

6. A gear setting assembly as recited in claim 3 wherein said yoke-biasing means comprises a laterally-extending spring for resisting lateral movement of the yoke into the enabled position.

7. For use in a postal meter having a rotatable printing drum and means for rotating said drum and further having banks of print wheels which may be set to different positions to imprint a selected postage amount and a gearing assembly for setting the print wheels and comprising a number of laterally-spaced, independently-rotatable gears, an improved gear-setting mechanism including:

a. a laterally-moveable yoke including restraining means for normally preventing rotational movement of the independently-rotatable gears;

b. a master gear rotatably mounted within said yoke for engaging a single one of the independently-rotatable gears at a time, during which time the engaged independently-rotatable gear can be rotated by the master gear;

c. a print interlock means for normally preventing the printing of postage amounts by the postal meter, said print interlock means further comprising:

1. a shutter bar which can extend into and block the path of movement of said means for rotating said printing drum;

2. an extension of said laterally-moveable yoke for holding the shutter bar in a blocking position when said yoke is in any position other than an enabled position;

3. means for driving said shutter bar from the blocking position to a released position only when said laterally-moveable yoke has been driven into said enabled position;

d. means for biasing said yoke toward a disabled position wherein said print interlock means prevents printing of postage amounts and wherein each of said independently rotatable gears is restrained from rotational movement by the restraining means on said laterally-moveable yoke; and e. means for urging said yoke laterally into said enabled position wherein said print interlock means is released to permit printing of postage amounts but each of the independently-rotatable gears continues to be restrained from rotational movement.

8. An improved gear-setting mechanism as recited in claim 7 wherein said rotation-restraining means on said yoke comprises at least one set of spaced walls defining a trough for receiving a tooth of each of the independently-rotatable gears.

9. An improved gear-setting mechanism as recited in claim 8 wherein said yoke-biasing means comprises a laterally-extending spring for resisting lateral movement of the yoke into the enabled position.

10. An improved gear-setting mechanism as recited in claim 7 wherein said yoke-biasing means comprises a laterally-extending spring for resisting lateral movement of the yoke into the enabled position.

* * * * *

UNITED STATES PATENT AND TRADEMARK OFFICE

CERTIFICATE OF CORRECTION

PATENT NO. : 4,050,374

DATED : September 27, 1977

INVENTOR(S) : Frank T. Check, Jr.

It is certified that error appears in the above-identified patent and that said Letters Patent are hereby corrected as shown below:

Column 5, line 50, change "001" to -- 011 --.

Claim 3, column 8, line 64, change second occurrence of "a" to -- and --.

Signed and Sealed this

*Twenty-sixth* Day of *September 1978*

[SEAL]

*Attest:*

RUTH C. MASON
*Attesting Officer*

DONALD W. BANNER
*Commissioner of Patents and Trademarks*